US011209235B2

(12) United States Patent
Nishikawa et al.

(10) Patent No.: US 11,209,235 B2
(45) Date of Patent: Dec. 28, 2021

(54) ARCHERY BOW AND HANDLE RISER AND LIMB

(71) Applicant: NISHIKAWA SEIKI SEISAKUSHO CO., LTD., Tokyo (JP)

(72) Inventors: Yoshihisa Nishikawa, Tokyo (JP); Yoshiyuki Kuribayashi, Tokyo (JP); Sachio Hongo, Tokyo (JP)

(73) Assignee: NISHIKAWA SEIKI SEISAKUSHO CO., LTD., Tokyo (JP)

( * ) Notice: Subject to any disclaimer, the term of this patent is extended or adjusted under 35 U.S.C. 154(b) by 0 days.

(21) Appl. No.: 16/625,520

(22) PCT Filed: Jul. 23, 2018

(86) PCT No.: PCT/JP2018/027545
§ 371 (c)(1),
(2) Date: Dec. 20, 2019

(87) PCT Pub. No.: WO2019/146143
PCT Pub. Date: Aug. 1, 2019

(65) Prior Publication Data

US 2021/0055072 A1 Feb. 25, 2021

(30) Foreign Application Priority Data

Jan. 26, 2018 (JP) ..... JP2018-011636

(51) Int. Cl.
*F41B 5/00* (2006.01)
*F41B 5/14* (2006.01)

(52) U.S. Cl.
CPC ..... *F41B 5/1426* (2013.01); *F41B 5/00* (2013.01)

(58) Field of Classification Search
CPC ..... F41B 5/00; F41B 5/10; F41B 5/14
See application file for complete search history.

(56) References Cited

U.S. PATENT DOCUMENTS 4,091,790 A * 5/1978 Hoyt, Jr. ..... F41B 5/0026 124/88
4,494,521 A * 1/1985 Quartino ..... F41B 5/0052 124/23.1

(Continued)

FOREIGN PATENT DOCUMENTS

JP H07-002788 U 1/1995
KR 10-2010-0136385 A 11/2012

OTHER PUBLICATIONS

International Search Report issued in Application No. PCT/JP2018/027545, dated Oct. 16, 2018.

*Primary Examiner* — John A Ricci
(74) *Attorney, Agent, or Firm* — Michael Best & Friedrich LLP

(57) ABSTRACT

At a second fitting part, inclination of the limb can be easily adjusted and corrected by an eccentric locator. The archery bow is characterized in that: the limb-side second fitting part of a limb has a projection with a convex cross section protruding from the surface of the limb of the limb-side second fitting part; the handle riser-side second fitting part of a handle riser has a housing part with a concave cross section to house the projection with a convex cross section; in the housing part, a side face near a bottom is smaller in diameter than an opening; and the limb and the handle riser are joined by joining the limb-side first fitting part and the handle riser-side first fitting part and joining the limb-side second fitting part and the handle riser-side second fitting part. The limb and handle are prevented from vibrating left and right.

14 Claims, 9 Drawing Sheets

(56) References Cited

U.S. PATENT DOCUMENTS

| | | | | | |
|---|---|---|---|---|---|
| 5,231,970 | A * | 8/1993 | Ploot | F41B 5/10 | 124/23.1 |
| 5,339,790 | A * | 8/1994 | Smith | F41B 5/10 | 124/23.1 |
| 5,464,001 | A * | 11/1995 | Peck | F41B 5/10 | 124/23.1 |
| 5,487,373 | A * | 1/1996 | Smith | F41B 5/10 | 124/23.1 |
| 6,244,259 | B1 * | 6/2001 | Adkins | F41B 5/0026 | 124/23.1 |
| 9,103,622 | B2 * | 8/2015 | Park | F41B 5/10 | |
| 2013/0047971 | A1 | 2/2013 | Jolley et al. | | |
| 2014/0360479 | A1 | 12/2014 | Park et al. | | |

* cited by examiner

BACKGROUND ART

BACKGROUND ART

BACKGROUND ART

BACKGROUND ART

ARCHERY BOW AND HANDLE RISER AND LIMB

TECHNICAL FIELD

The present invention relates to archery. Particularly, it relates to the joint between a limb and a handle riser of an archery bow, and a handle riser and a limb joint. More particularly, it relates to the joint between a limb and a handle riser of the archery bow, and a handle riser and a limb joint which make it possible to adjust and correct the inclination of the limb by an eccentric locator easily.

BACKGROUND ART

In the past, a handle riser and a limb in the archery bow has been joined by inserting the limb into the handle riser and fastening it as illustrated and described in "TAKE-DOWN BOW" (PTL 1, Japanese Patent Application Laid-Open No. 1984-185997, FIGS. 3 and 4).

Next, a further explanation will be given referring to FIGS. 13 to 22 as schematic views which illustrate the conventional technique.

In a conventional archery bow 501, a limb 511 and a handle riser 521 are joined by mutually fixing two fitting parts provided on each of them, 512, 513, 522, and 523.

The limb 511 includes a limb-side first fitting part 512 located at the tip of the limb 511 and a limb-side second fitting part 513 located nearer to the center of the limb 511 than the limb-side first fitting part 512.

The limb-side first fitting part 512 is formed with a concave cross section in the center of the tip for fitting the limb 511 to the handle riser 521.

The limb-side second fitting part 513 is located nearer to the center of the limb 511 than the limb-side first fitting part 512. The limb-side second fitting part 513 is a lock part as a cylindrical screw and fitted almost perpendicularly to the limb 511 with its tip protruding from the limb 511. The end 514 of the screw has a larger diameter than the center of the screw. A spherical limb-side lock part 515 is provided in the center of the tip of the screw as the limb-side second fitting part 513.

The handle riser 521 includes a handle riser-side second fitting part 523 located at the tip of the handle riser 521 and a handle riser-side first fitting part 522 located nearer to the center of the handle riser 521 than the handle riser-side second fitting part 523.

The handle riser-side first fitting part 522 is a limb bolt as a screw. The limb bolt is fitted to the handle riser 521 almost perpendicularly to the longitudinal direction of the handle riser 521 in a manner to protrude from the surface of the handle riser 521.

The handle riser-side second fitting part 523 includes a bottom plate 524 and a surface plate 525 which are laminated. A clearance 526 is provided between the bottom plate 524 and the surface plate 525.

The surface plate 525 has an opening made in the end area with a concave cross section. A handle riser-side lock part 527 with a spherical concave cross section is provided on the bottom plate 524 nearer to the center of the handle riser 521.

The limb-side first fitting part 512 with a concave cross section, which is provided in the limb 511, is inserted onto the limb bolt as the handle riser-side first fitting part 522 of the handle riser 521 to fix.

The large-diameter portion at the tip of the limb-side second fitting part 513, protruding from the limb 511, is inserted into the clearance 526 between the bottom plate 524 and surface plate 525 through the opening with a concave cross section, made in the end area of the surface plate 525 of the handle riser-side second fitting part 523, and moved toward the center of the handle riser 521 and inserted.

The limb-side lock part 515 is fitted to the handle riser-side lock part 527 to fix the limb 511 and the handle riser 521.

CITATION LIST

Patent Literature

PTL 1: Japanese Patent Application Laid-Open No. 1984-185997

PTL 2: Japanese Utility Model Application Laid-Open No. 1995-002788

SUMMARY OF INVENTION

Technical Problem

However, when the limb 511 and the handle riser 521 are joined in this way, there is a problem that during use, the limb 511 vibrates left and right due to vibration of the joint between the handle riser 521 and limb 511 (FIG. 14). Therefore, one problem is that the arrow flies unstably and the possibility that the arrow hits or misses the target is likely to fluctuate.

In archery, the basic design of fitting parts such as the handle riser-side first fitting part 522, handle riser-side second fitting part 523, limb-side first fitting part 512, and limb-side second fitting part 513 has been unchanged since more than five decades ago. Meanwhile, the materials of the string, arrow, and limb have changed. For this reason, the load on the limb 511 and handle riser 521 at the time of launch has drastically increased, leading to the fact that the fitting parts are seriously damaged. For the above reason, it seems that lack of accuracy has caused lack of hardness.

In addition, as shown in FIG. 22, when the limb 511 and the handle riser 521 are joined, the tip of the limb 511 comes into point contact with the handle riser-side second fitting part 523 at Point A, thereby causing vibration to occur.

Furthermore, the machining accuracy of the limb 511 and handle riser 521 may vary. The limb 511 is often treated as a general-purpose item. Therefore, when joining the limb 511 and handle riser 521, correction is required.

Furthermore, the conventional method for joining the limb 511 and handle riser 521 causes left/right misalignment of the limb due to the lack of accuracy and strength. Furthermore, in most types of archery bows, the limb 511 and handle riser 521 cannot be joined with the string put between them and the limb 511 and handle riser 521 must be separately handled, which means that a kind of intuition is required in joining them.

For an unexperienced archer, it takes several tens of minutes to make an adjustment.

For the above reasons, the handle riser-side first fitting part 522, handle riser-side second fitting part 523, limb-side first fitting part 512, and limb-side second fitting part 513 are expected to be improved.

On the other hand, it is known that the handle riser-side second fitting part can be made inclinable.

Specifically, "the limb 12 is supported by the handle riser 11 at two points, a spot for fitting the limb-side limb set screw 35 in the end area and an adjusting screw insertion part 18" (PTL 2 Japanese Utility Model Application Laid-Open No. 1995-002788 "LIMB FOR ARCHERY" [0018], FIGS. 1, 2, and 7).

"When fitting the limb 12 to the handle riser 11, the adjusting screw 23 is loosely screwed into the adjusting screw support 21 and the adjusting screw insertion part 18 is first inserted in the middle portion of the adjusting screw 23. Then, the handle riser-side limb set screw 31 is inserted from outside the through hole 17 so that the handle riser-side limb set screw 31 and limb-side limb set screw 35 are screwed with each other. As shown in FIG. 1, the screwing amount of the adjusting screw 23 and handle riser-side limb set screw is adjusted according to the fitting angle between the limb 12 and handle riser 11 to fix as shown in FIG. 2" (PTL 2 Japanese Utility Model Application Laid-Open Publication 1995-002788 "LIMB FOR ARCHERY" [0019] FIGS. 1, 2, and 7).

"21 denotes an adjusting screw support. The lower portion of the adjusting screw support 21 is spherical and supported by a bearing 22 with a spherical inner surface which is fitted to the bottom of a groove under an opening made in the cover. Therefore, the adjusting screw support 21 is rotatable and inclinable to the extent that the spherical surfaces slide mutually, and its tip protrudes from the groove surface" (PTL 2 Japanese Utility Model Application Laid-Open Publication 1995-002788 "LIMB FOR ARCHERY" [0012] FIGS. 1, 2, and 7).

Solution to Problem

The present invention provides an archery bow comprising:

a limb including a limb-side first fitting part located at a tip and a limb-side second fitting part located nearer to a center than the limb-side first fitting part; and a handle riser including a handle riser-side second fitting part located at a tip and a handle riser-side first fitting part located nearer to a center than the handle riser-side second fitting part, wherein either the limb-side second fitting part or the handle riser-side second fitting part is a projection protruding from a surface, either the limb-side second fitting part or the handle riser-side second fitting part which has no projection is a housing part to house the projection, in the housing part, a side face near a bottom is smaller in diameter than an opening, and the limb and the handle riser are joined by joining the limb-side first fitting part and the handle riser-side first fitting part and joining the limb-side second fitting part and the handle riser-side second fitting part.

The present invention provides an archery bow comprising:

a limb including a limb-side first fitting part located at a tip and a limb-side second fitting part located nearer to a center than the limb-side first fitting part; and a handle riser including a handle riser-side second fitting part located at a tip and a handle riser-side first fitting part located nearer to a center than the handle riser-side second fitting part, wherein the limb-side second fitting part has a projection protruding from a surface of the limb, the handle riser-side second fitting part has a housing part to house the projection, in the housing part, a side face near a bottom is smaller in diameter than an opening, and the limb and the handle riser are joined by joining the limb-side first fitting part and the handle riser-side first fitting part and joining the limb-side second fitting part and the handle riser-side second fitting part.

The present invention provides an archery bow comprising:

a limb including a limb-side first fitting part located at a tip and a limb-side second fitting part located nearer to a center than the limb-side first fitting part; and a handle riser including a handle riser-side second fitting part located at a tip and a handle riser-side first fitting part located nearer to a center than the handle riser-side second fitting part, wherein the handle riser-side second fitting part has a projection protruding from a surface of the handle riser, the limb-side second fitting part has a housing part to house the projection, in the housing part, a side face near a bottom is smaller in diameter than an opening, and the limb and the handle riser are joined by joining the limb-side first fitting part and the handle riser-side first fitting part and joining the limb-side second fitting part and the handle riser-side second fitting part.

The present invention provides a limb, which is characterized to be join to a handle riser including a handle riser-side second fitting part located at a tip and a handle riser-side first fitting part located nearer to a center than the handle riser-side second fitting part, comprising:

a limb-side first fitting part located at a tip and a limb-side second fitting part located nearer to a center than the limb-side first fitting part, wherein either the limb-side second fitting part or the handle riser-side second fitting part is a projection protruding from a surface, either the limb-side second fitting part or the handle riser-side second fitting part which has no projection is a housing part to house the projection, in the housing part, a side face near a bottom is smaller in diameter than an opening, and the limb is joined to the handle riser by joining the limb-side first fitting part and the handle riser-side first fitting part and joining the limb-side second fitting part and the handle riser-side second fitting part.

The present invention provides a limb, which is characterized to be join to a handle riser including a handle riser-side second fitting part located at a tip and a handle riser-side first fitting part located nearer to a center than the handle riser-side second fitting part, wherein the handle riser-side second fitting part having a projection protruding from a surface of the handle riser, comprising:

a limb-side first fitting part located at a tip and a limb-side second fitting part located nearer to a center than the limb-side first fitting part, wherein the limb-side second fitting part has a housing part to house the projection, in the housing part, a side face near a bottom is smaller in diameter than an opening, and the limb is joined to the handle riser by joining the limb-side first fitting part and the handle riser-side first fitting part and joining the limb-side second fitting part and the handle riser-side second fitting part.

The present invention provides a limb, which is characterized to be join to a handle riser including a handle riser-side second fitting part located at a tip and a handle riser-side first fitting part located nearer to a center than the handle riser-side second fitting part, wherein the handle riser-side second fitting part having a housing part to house a projection, and in the housing part, a side face near a bottom being smaller in diameter than an opening, comprising:

a limb-side first fitting part located at a tip and a limb-side second fitting part located nearer to a center than the limb-side first fitting part, wherein the limb-side second fitting part has a projection protruding from a surface of the limb, and the limb is joined to the handle riser by joining the limb-side first fitting part and the handle riser-side first fitting part and joining the limb-side second fitting part and the handle riser-side second fitting part.

The present invention provides a handle riser, which is characterized to be join to a limb including a limb-side first fitting part located at a tip and a limb-side second fitting part located nearer to a center than the limb-side first fitting part, comprising:

a handle riser-side second fitting part located at a tip and a handle riser-side first fitting part located nearer to a center than the handle riser-side second fitting part, wherein either the limb-side second fitting part or the handle riser-side second fitting part is a projection protruding from a surface, either the limb-side second fitting part or the handle riser-side second fitting part which has no projection is a housing part to house the projection, in the housing part, a side face near a bottom is smaller in diameter than an opening, and the handle riser is joined to the limb by joining the limb-side first fitting part and the handle riser-side first fitting part and joining the limb-side second fitting part and the handle riser-side second fitting part.

The present invention provides a handle riser, which is characterized to be join to a limb including a limb-side first fitting part located at a tip and a limb-side second fitting part located nearer to a center than the limb-side first fitting part, wherein the limb-side second fitting part having a projection protruding from a limb surface, comprising:

a handle riser-side second fitting part located at a tip and a handle riser-side first fitting part located nearer to a center than the handle riser-side second fitting part, the handle riser-side second fitting part having a housing part to house the projection, wherein in the housing part, a side face near a bottom is smaller in diameter than an opening, and the handle riser is joined to the limb by joining the limb-side first fitting part and the handle riser-side first fitting part and joining the limb-side second fitting part and the handle riser-side second fitting part.

The present invention provides a handle riser, which is characterized to be join to a limb including a limb-side first fitting part located at a tip and a limb-side second fitting part located nearer to a center than the limb-side first fitting part, wherein the limb-side second fitting part having a housing part to house a projection, and in the housing part, a side face near a bottom being smaller in diameter than an opening, comprising:

a handle riser-side second fitting part located at a tip and a handle riser-side first fitting part located nearer to a center than the handle riser-side second fitting part, wherein the handle riser-side second fitting part having a projection protruding from a surface of the handle riser, and the handle riser is joined to the limb by joining the limb-side first fitting part and the handle riser-side first fitting part and joining the limb-side second fitting part and the handle riser-side second fitting part.

In the present invention, it is further that the housing part of the handle riser or the limb is cylindrical, and the based portion of the projection is column-shaped, and a large-diameter portion with a larger diameter than a base portion is provided at the tip.

In the present invention, it is further that the housing part provided in the handle riser or the limb has a diameter which decreases toward the bottom.

In the present invention, it is further that in the handle riser or the limb a projection-shaped lock part is provided at a tip of the projection and a lock housing part with a concave cross section to house the lock part is provided in a center of the housing part.

In the present invention, it is further that in the handle riser or the limb the handle riser-side first fitting part is constantly biased toward the center of the handle riser and a head can move with a base portion as an axis.

Advantageous Effects of Invention

Either the limb-side second fitting part or the handle riser-side second fitting part has a projection protruding from the tip of the second fitting part and either the limb-side second fitting part or handle riser-side second fitting part which has no projection is a housing part which houses the projection.

In the housing part, the side face near the bottom is smaller in diameter than the opening, and by joining the limb-side first fitting part and the handle riser-side first fitting part and joining the limb-side second fitting part and the handle riser-side second fitting part, the limb and the handle riser are joined to assemble the archery bow.

Therefore, the limb and handle riser do not vibrate left and right. In the second fitting parts, the inclination of the limb can be easily adjusted and corrected by the eccentric locator.

When the handle riser or limb has a projection-shaped lock part at the tip of the projection and a lock housing part with a concave cross section to house the lock part is provided in the center of the housing part, the limb can move elliptically with respect to the handle riser, centering on the lock part and lock housing part.

When joining the limb and the handle riser, by deviating the lock part and lock housing part from the center and making a correction with a string put between the limb and the handle riser, the lock part and the lock housing part can be centered accurately. Therefore, the limb and handle riser of any kind can be joined smoothly.

DESCRIPTION OF EMBODIMENTS

Next, an embodiment will be described referring to FIGS. 1 to 11 which show the first embodiment.

1 denotes an archery bow. 11 denotes a limb of the archery bow 1. 12 denotes a limb-side first fitting part. 13 denotes a limb-side second fitting part.

The limb-side first fitting part 12 is located at the tip of the limb 11. The limb-side first fitting part 12 is a concave part with a concave form in a plan view at the tip of the limb 11. The limb-side second fitting part 13 is located nearer to the center of the limb 11 than the limb-side first fitting part 12.

Figure 3:
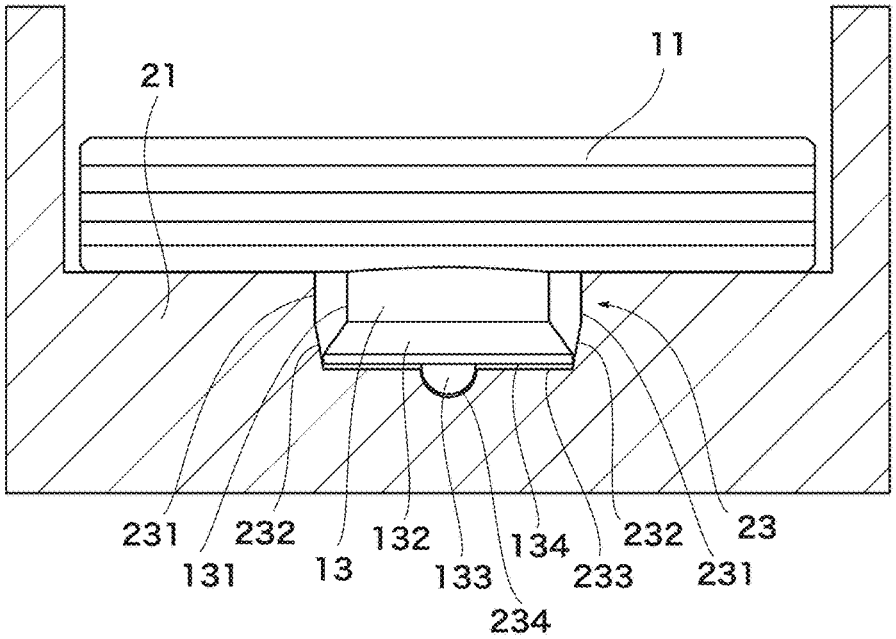
FIG. 3 is a fragmentary enlarged front sectional view of the limb and handle riser joined according to the first embodiment of the present invention.
Figure 4:
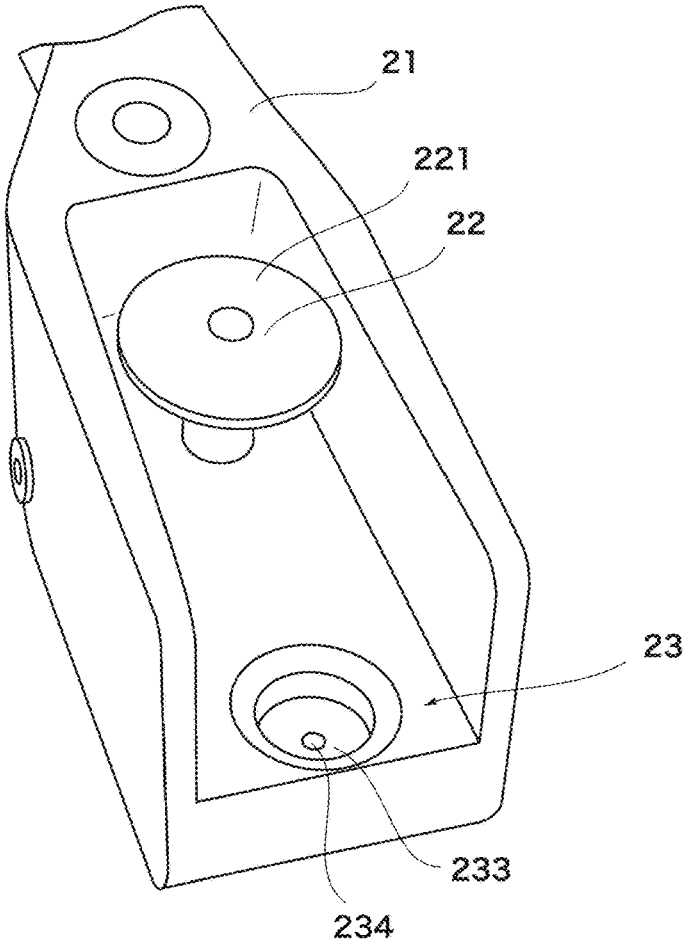
FIG. 4 is a fragmentary enlarged perspective view of the end area of the handle riser according to the first embodiment of the present invention.
Figure 5:
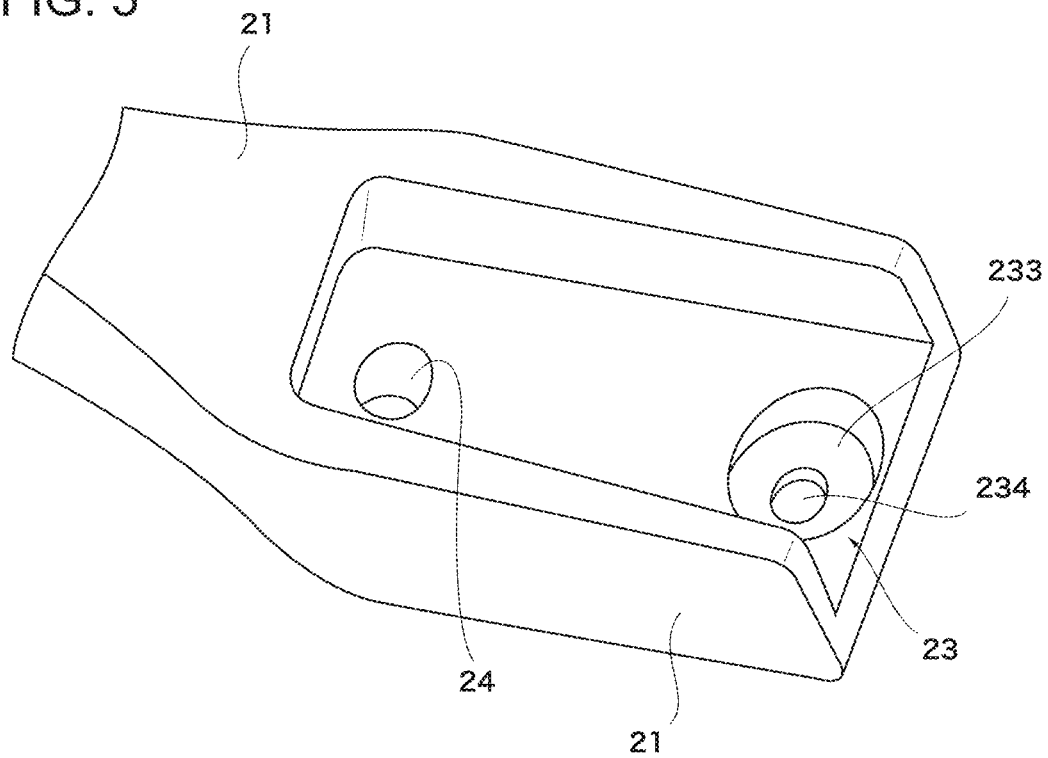
FIG. 5 is a fragmentary enlarged perspective view of the end area of the handle riser according to the first embodiment of the present invention in which the handle riser-side first fitting part is disengaged.

131 denotes a projection. The projection 131 protrudes from the surface of the limb 11 in a cylindrical form as a whole with a convex cross section, constituting the limb-side second fitting part 13. The projection 131 has a cylindrical base portion with the same diameter as shown in FIG. 3.

132 denotes a large-diameter portion. The large-diameter portion 132 is located at the tip of the same-diameter cylindrical base portion of the projection 131 as shown in FIG. 3. The large-diameter portion 132 is larger in diameter than the cylindrical base portion, its diameter increases toward the tip and its cross section is almost trapezoidal as shown in FIG. 3.

134 denotes the large-diameter portion bottom. The large-diameter portion bottom 134 is an end face of the large-diameter portion 132 and is a flat surface.

133 denotes a lock part. The lock part 133 protrudes in a semispherical form from the center of the large-diameter portion bottom 134 at the tip of the limb-side second fitting part 13.

In the first embodiment, the projection 131 protrudes from the surface of the limb 11 on the limb-side second fitting part 13.

21 denotes the handle riser of the archery bow 1. 22 denotes a handle riser-side first fitting part. 23 denotes a handle riser-side second fitting part.

The handle riser-side second fitting part 23 is located at the tip of the handle riser 21. The handle riser-side first fitting part 22 is located nearer to the center of the handle riser 21 than the handle riser-side second fitting part 23. The handle riser-side first fitting part 22 is a limb bolt as shown in FIGS. 2, 4, 7, 10, and 11.

Figure 1:
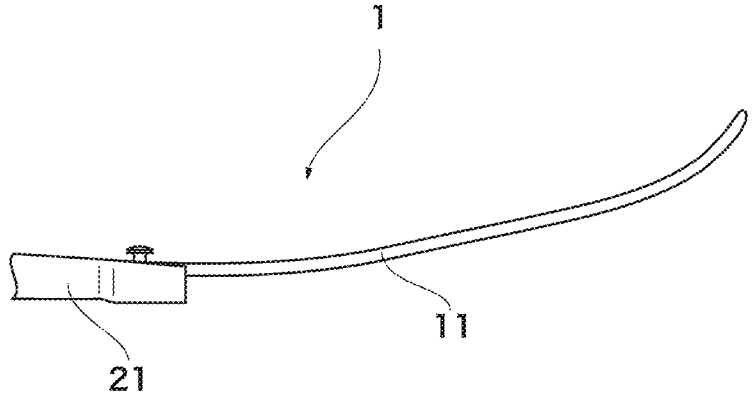
FIG. 1 is a side view of the limb and handle riser joined according to a first embodiment of the present invention.
Figure 2:
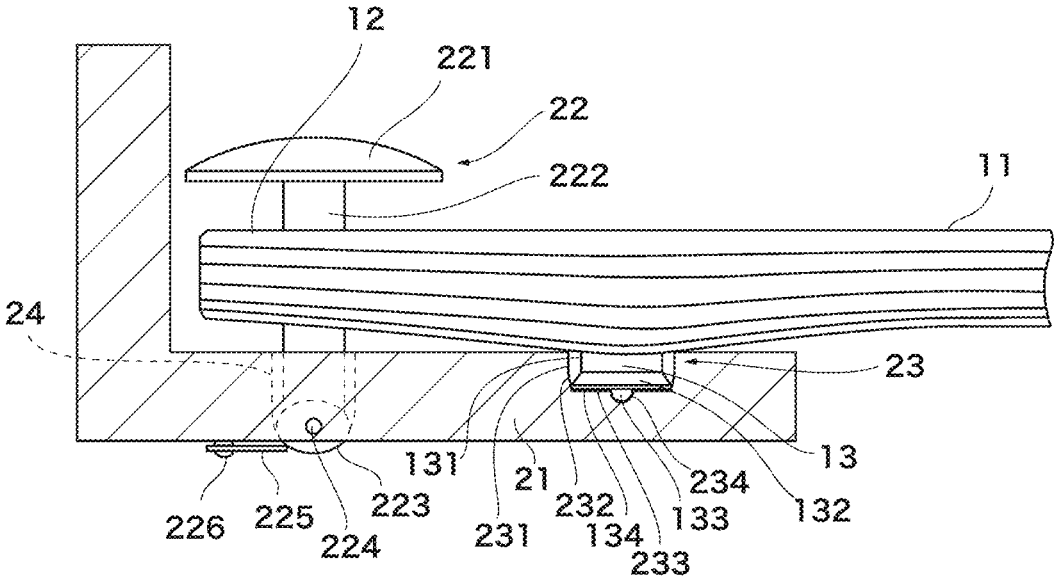
FIG. 2 is a fragmentary enlarged side sectional view of the limb and handle riser joined according to the first embodiment of the present invention.

221, as shown in FIG. 2 and other figures, denotes a limb bolt head. 222 denotes a limb bolt shaft. The limb bolt head 221 is integrally located over the limb bolt shaft 222. 223 denotes a limb bolt base portion. The limb bolt base portion 223 is cylindrical and horizontally fitted under the limb bolt shaft 222. 227 denotes a plate spring contact part which lies on the limb bolt base portion 223 in a planar form. 224 denotes a limb bolt rotation axis. The limb bolt rotation axis 224 penetrates the limb bolt base portion 223 and is fitted to the handle riser 21. Instead, a plate spring 225 may be pushed against the limb bolt rotation axis 224 without the limb bolt base portion 223.

24 denotes a limb bolt housing hole. The limb bolt housing hole 24 is cylindrical with a larger width than the handle riser-side first fitting part 22 as the limb bolt. The handle riser-side first fitting part 22 as the limb bolt is fitted to the handle riser 21 by putting it in the limb bolt housing hole 24.

Therefore, the upper portion and head of the handle riser-side first fitting part 22 as the limb bolt can move toward the center and the tip in the limb bolt housing hole 24 with the limb bolt rotation axis 224 in the base portion as the axis of rotation.

225 denotes a plate spring. 226 denotes a plate spring fixing part. One end of the plate spring 225 is fixed on the bottom of the handle riser 21 by the plate spring fixing part 226.

Figure 6:
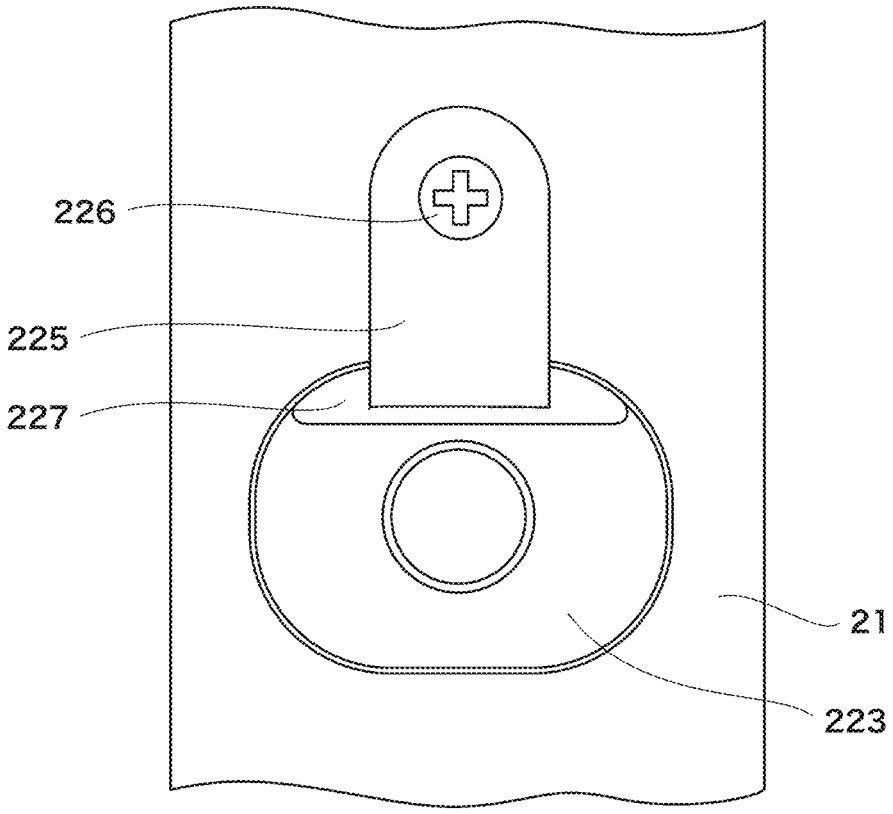
FIG. 6 is a fragmentary enlarged back view of the limb and handle riser according to the first embodiment of the present invention.

As shown in FIG. 6, the plate spring 225 pushes the handle riser-side first fitting part 22 as the limb bolt toward the tip of the handle riser 21 constantly in contact with the plate spring contact part 227 and orients the limb bolt head 221 toward the end area of the handle riser 21. Then, movement can be made only in the longitudinal direction of the handle riser 21.

In the first embodiment, the handle riser-side second fitting part 23, which does not have the projection 131 with a convex cross section, includes a housing part 231 with a concave cross section which is a cylindrical space as a whole to house the projection with a convex cross section.

232 denotes an inclined portion of the housing part 231, 233 denotes the bottom of the same, and 234 denotes the lock housing part of the same. As shown in FIG. 3 and other figures, the inclined portion 232 is an inclined side face near the bottom of the housing part 231 with a concave cross section as the handle riser-side second fitting part 23. The inclined portion 232 has an inside diameter which decreases toward the bottom, and due to the inclined portion 32, the housing part 231 has a diameter which decreases toward the bottom and the concave cross section has a width which decreases downward.

The reason that the diameter of the housing part 231 decreases toward the bottom is that the diameter of the limb-side second fitting part 13 has not been standardized so far by the limb makers and when the diameter of the housing part 231 is decreased toward the bottom, locking occurs at some point on the inner surface of the housing part 231. If the diameter of the housing part 231 is not decreased toward the bottom but its shape is straight and cylindrical, looseness would occur with the limb-side second fitting part 13. In order to place the limb-side second fitting part 13 in the housing part 231 securely and accurately without causing any looseness, the diameter of the housing part 231 is decreased toward the bottom.

In the case of only one maker or if the diameter of the limb-side second fitting part 13 is standardized, the housing part 231 need not have a diameter which decreases toward the bottom thanks to the standardization of the diameter of the limb-side second fitting part 13 and it may be straight and cylindrical.

234 denotes a lock housing part. The lock housing part 234 is located in the center of the housing part 231 with a concave cross section as the handle riser-side second fitting part 23, with a roughly semispherical concave cross section. The lock housing part 234 houses the lock part 133 in its concave cross section part.

The diameter of the bottom of the lock housing part 234 with a round concave cross section decreases toward the bottom and its cross section is roughly semispherical.

Next, the way to assemble the archery bow by joining the limb 11 and the handle riser 21 will be described.

Figure 7:
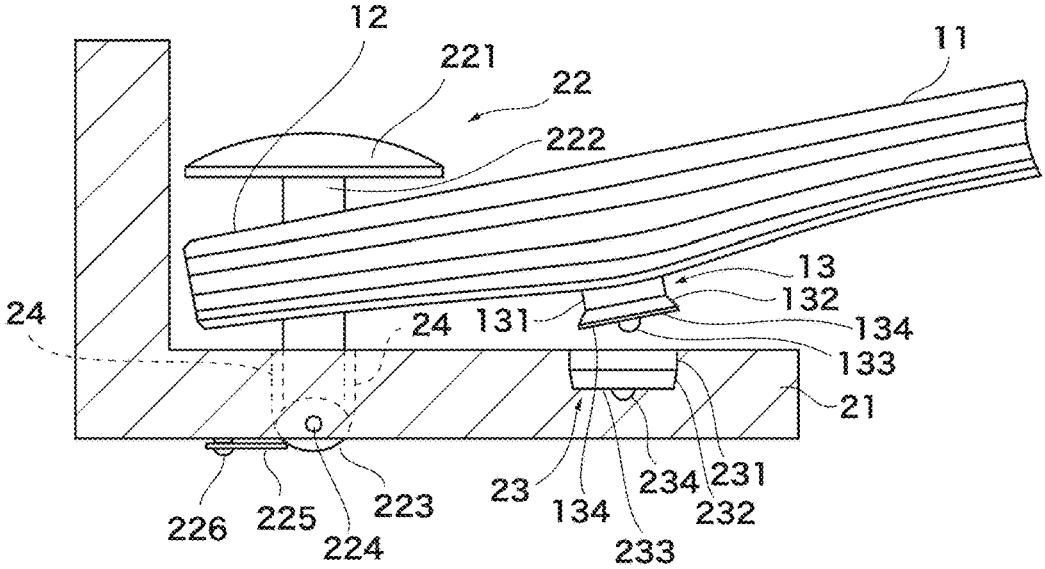
FIG. 7 is a fragmentary enlarged side sectional view of the limb and handle riser which is about to be joined according to the first embodiment of the present invention.

As shown in FIG. 7, the limb-side first fitting part 12 in the limb 11 as a concave part in a plan view is inserted on the handle riser-side first fitting part 22 as the limb bolt in the handle riser 21.

Figure 11:
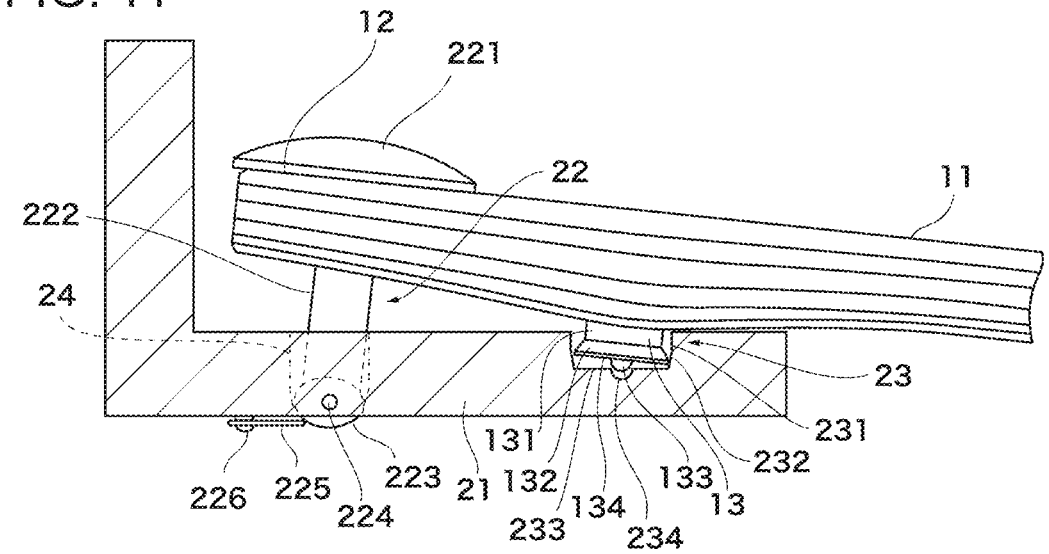
FIG. 11 is a fragmentary enlarged side sectional view of the limb and handle riser joined according to the first embodiment of the present invention.

As shown in FIG. 11, in the handle riser-side first fitting part 22 as the limb bolt, the upper portion can move toward the center or tip of the handle riser in the limb bolt housing hole 24 with the limb bolt rotation axis 224 as the axis of rotation.

Therefore, when the limb 11 and handle riser 21 are joined, even if the tip of the limb 11 touches the handle riser-side second fitting part 23, the handle riser-side first fitting part 22 moves and when the limb-side first fitting part 12 at the tip of the limb 11 is joined to the handle riser-side first fitting part 22, the limb-side first fitting part 12 does not collide the handle riser-side first fitting part 22 as the limb bolt head 221.

Figure 8:
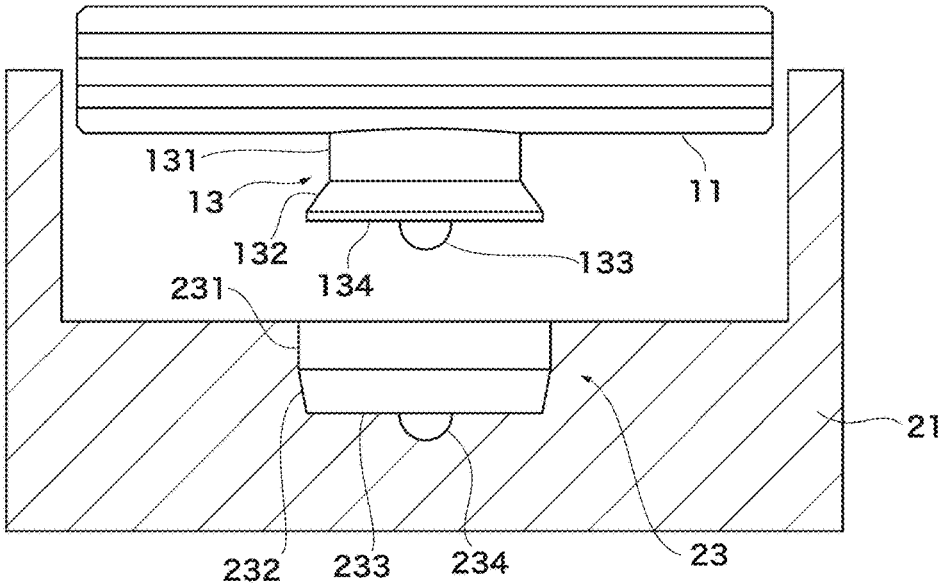
FIG. 8 is a fragmentary enlarged front sectional view of the limb and handle riser joined according to the first embodiment of the present invention.

Next, as shown in FIG. 8, the large-diameter portion 132 at the tip of the projection 131 of the limb-side second fitting part 13, protruding from the limb 11, is pushed into the housing part 231 of the handle riser-side second fitting part 23 so as to reach the bottom 233 through the inclined portion 232.

The lock part 133 in the limb 11 is pushed into the lock housing part 234 in the handle riser-side second fitting part 23 of the handle riser 21 and fixed.

By joining the limb-side first fitting part 12 and the handle riser-side first fitting part 22 and joining the limb-side second fitting part 13 and the handle riser-side second fitting part 23, the limb 11 and the handle riser 21 are fixed to assemble the archery bow.

The housing part 231 with a concave cross section as the handle riser-side second fitting part 23 has a diameter which decreases toward the bottom due to the inclined portion 232 and the side face near the bottom is smaller in diameter than the opening. The width of the housing part 231 decreases toward the bottom of the round concave cross section part and the width of the concave cross section decreases downward.

The large-diameter portion 132 at the tip of the projection 131 of the limb-side second fitting part 13, protruding from the limb 11, is inserted into the housing part 231 of the handle riser-side second fitting part 23 so as to reach the bottom 233 through the inclined portion 232.

The lock part 133 in the limb 11 is pushed into the lock housing part 234 in the handle riser-side second fitting part 23 of the handle riser 21 and fixed.

The side face of the large-diameter portion 132 at the tip of the projection 131 is held by the inclined portion 232. The lock part 133 is inserted into the lock housing part 234 and housed. Therefore, the limb 11 can move elliptically with respect to the handle riser 21, centering on the lock 133 and the lock housing part 234.

In addition, the machining accuracy of the limb 511 and the handle riser 521 may vary. The limb 511 is often treated as a general-purpose item. Therefore, when the limb 511 and the handle riser 521 are joined, correction is required.

However, in this embodiment, when the limb 11 and the handle riser 21 are joined, the lock part 133 and the lock housing part 234 can be centered accurately by deviating the lock part 133 and the lock housing part 234 from the center and making a correction with a string put between the limb 11 and the handle riser 21. Therefore, any kind of a limb 11 and a handle riser 21 can be joined smoothly.

On the other hand, as shown in FIGS. 7 to 10, when the limb 11 and the handle riser 21 are joined, even if the tip of the limb 11 touches the handle riser-side first fitting part 22, the handle riser-side first fitting part 22 moves toward the tip and center of the handle riser 21 and absorbs the resistance.

As shown in FIG. 11, when the limb 11 is inclined, the limb bolt is inclined to absorb the movement of the limb 11.

Figure 9:
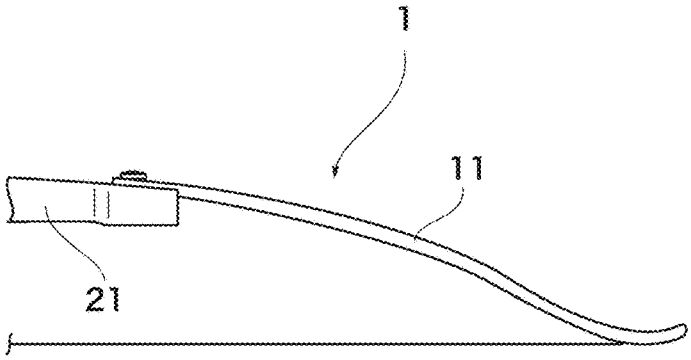
FIG. 9 is a side view of the limb and handle riser joined according to the first embodiment of the present invention.
Figure 10:
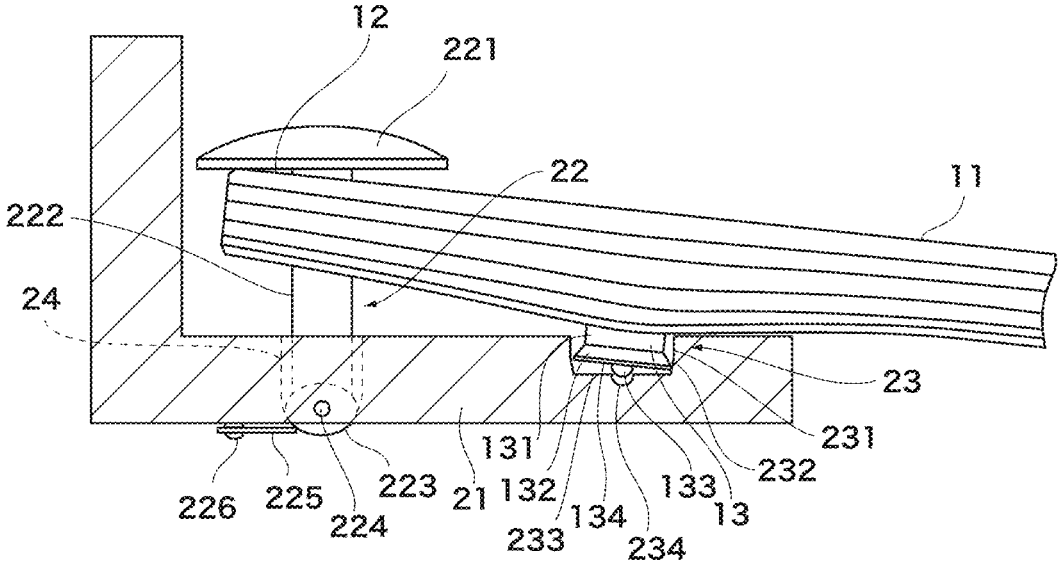
FIG. 10 is a fragmentary enlarged side sectional view of the limb and handle riser joined according to the first embodiment of the present invention.

Even if, in the state shown in FIG. 3 an impact is given to the archery bow during use after the limb 11 and handle riser 21 are joined, as shown in FIGS. 9, 10, and 11, the inclined portion 232 of the housing part 231 with a concave cross section and the large-diameter portion 132 at the tip of the projection 131 contact each other and, as shown in FIGS. 10 and 11, move and absorb the impact while changing the contact point, centering on the lock part 133 and lock housing part 234 in the housing part 231, so the limb 11 and handle riser 21 do not vibrate left and right.

Therefore, the joint between the limb 11 and handle riser 21 hardly vibrates.

In the first embodiment, in the second fitting parts, the inclination of the limb can be easily adjusted and corrected by the eccentric locator.

Next, a second embodiment will be described referring to FIG. 12.

In the second embodiment, a projection 131 is provided on the handle riser-side second fitting part 23 and a housing part 231 is provided in the limb-side second fitting part 13. The other structures are the same as in the first embodiment.

Specifically, the limb 11 includes a limb-side first fitting part 12 located at the tip and a limb-side second fitting part 13 located nearer to the center than the limb-side first fitting part 12.

The handle riser 21 includes a handle riser-side second fitting part 23 located at the tip and a handle riser-side first fitting part 22 located nearer to the center than the handle riser-side second fitting part 23.

The handle riser-side second fitting part 23 includes a projection 131 with a convex cross section protruding the surface of the limb 11 on the limb-side second fitting part 23.

The limb-side second fitting part 13 is a housing part 231 with a concave cross section as a cylindrical space as a whole to house the projection with a convex cross section. In the housing part 231, the side face near the bottom is smaller in diameter than the opening.

The lock part 133 protrudes semispherically from the center of the large-diameter portion bottom 134 at the tip of the limb-side second fitting part 13.

A lock housing part 234 is provided with a roughly semispherical concave cross section in the center of the housing part 231 with a concave cross section as the handle riser-side second fitting part 23.

The diameter of the bottom of the lock housing part 234 with a round concave cross section decreases toward the bottom and its cross section is roughly semispherical.

In the second embodiment, the handle riser-side second fitting part 23 includes the projection 131 with a convex cross section protruding from the tip of the handle riser-side second fitting part 23 and the projection 131 with a convex cross section as the handle riser-side second fitting part 23 is housed in the limb-side second fitting part 13 with a concave cross section which has no projection 131. The lock housing part 234 houses the lock part 133 in its concave cross section part. By taking the above steps, the limb-side first fitting part 12 and the handle riser-side first fitting part 22 are joined and the limb-side second fitting part 13 and the handle riser-side second fitting part 23 are joined so that the limb 11 and the handle riser 21 are joined.

The archery bow is assembled by joining the limb and the handle riser.

The side face of the large-diameter portion 132 at the tip of the projection 131 is held by the inclined portion 232. The lock part 133 is pushed into the lock housing part 234 and housed. Therefore, the limb 11 can move elliptically with respect to the handle riser 21, centering on the lock 133 and the lock housing part 234.

Figure 12:
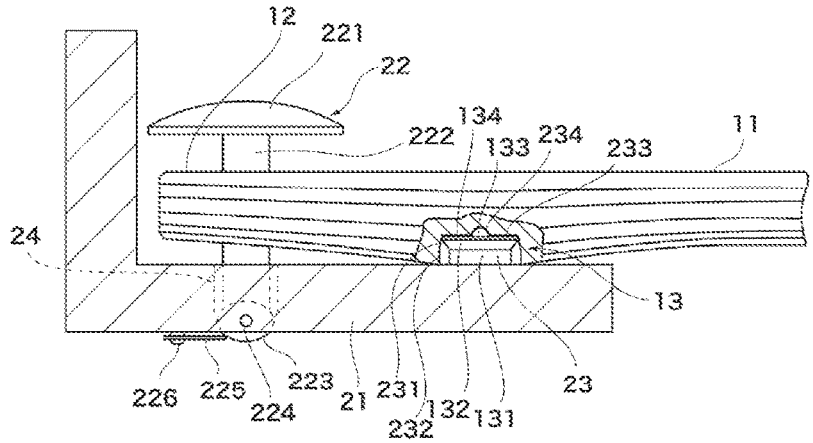
FIG. 12 is a fragmentary enlarged side sectional view of the limb and handle riser joined according to a second embodiment of the present invention.
Figure 13:
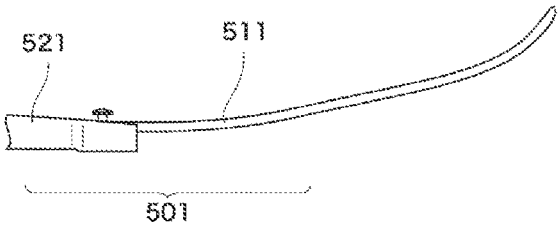
FIG. 13 is a side view of the limb and handle riser joined in the conventional technique.
Figure 14:
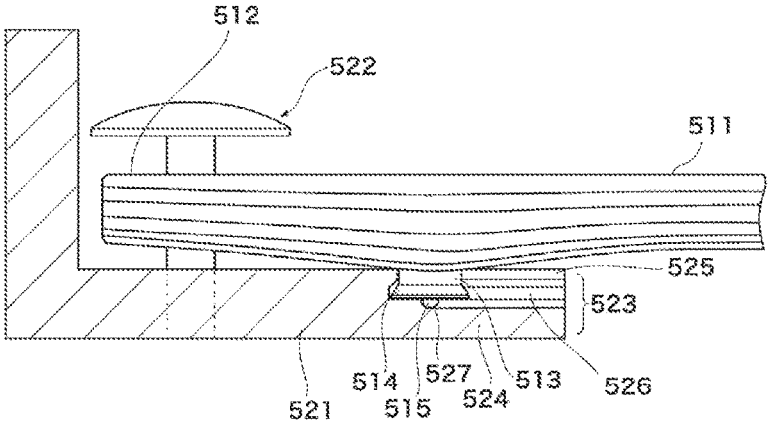
BACKGROUND ART FIG. 14
FIG. 14 is a fragmentary enlarged side sectional view of the limb and handle riser joined in the conventional technique.
Figure 15:
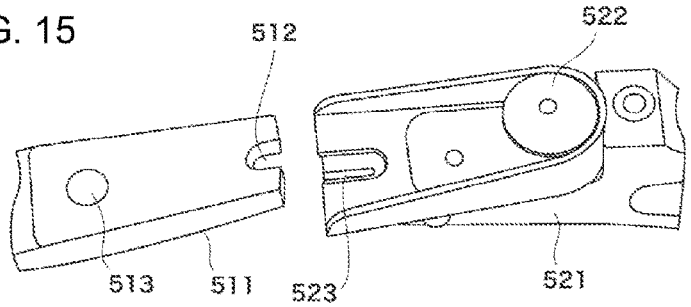
FIG. 15 is a fragmentary enlarged perspective view of the limb and handle riser which are prepared to be joined in the conventional technique.
Figure 16:
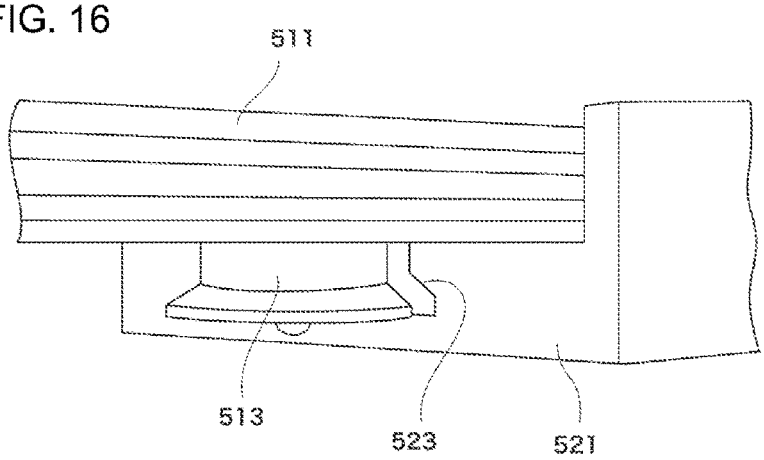
BACKGROUND ART FIG. 16
FIG. 16 is a fragmentary enlarged perspective view of the limb and handle riser which are being joined in the conventional technique.
Figure 17:
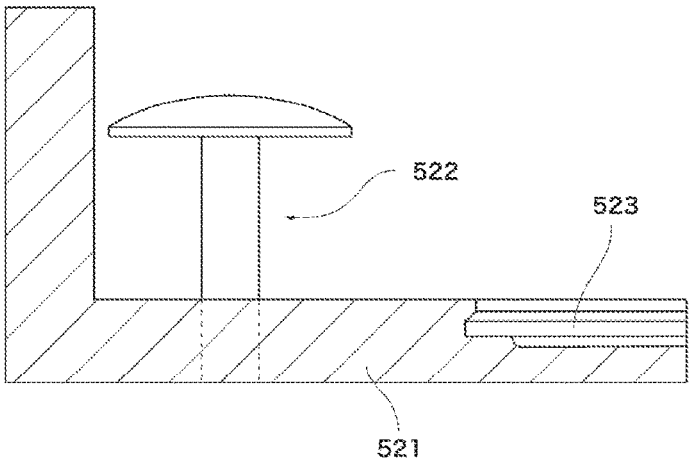
BACKGROUND ART FIG. 17
FIG. 17 is a fragmentary enlarged sectional view of the handle riser in the conventional technique.
Figure 18:
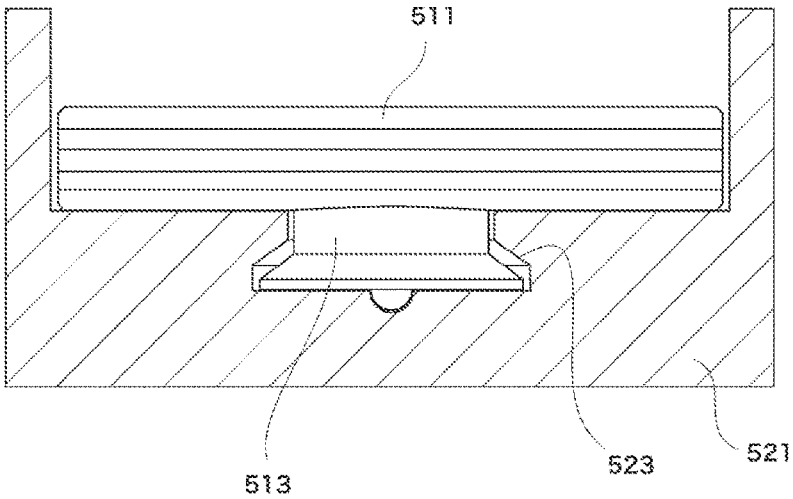
FIG. 18 is a fragmentary enlarged front sectional view of the limb and handle riser joined in the conventional technique.
Figure 19:
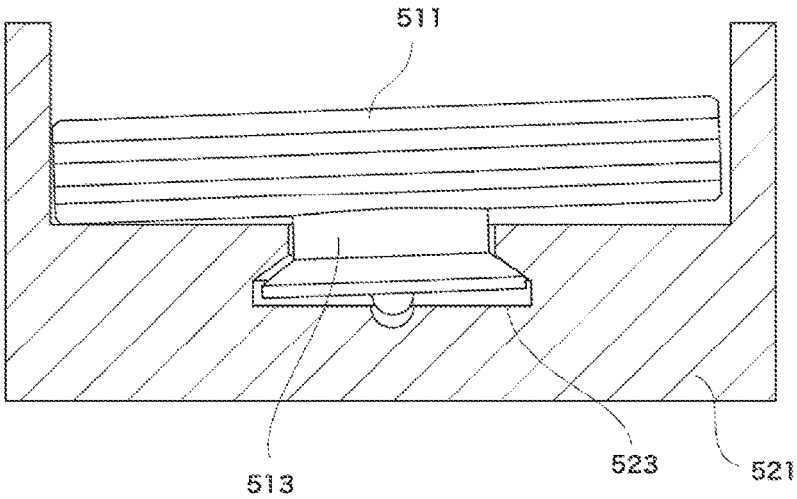
BACKGROUND ART FIG. 19
FIG. 19 is a fragmentary enlarged front sectional view of the limb and handle riser which are joined and in use in the conventional technique.
Figure 20:
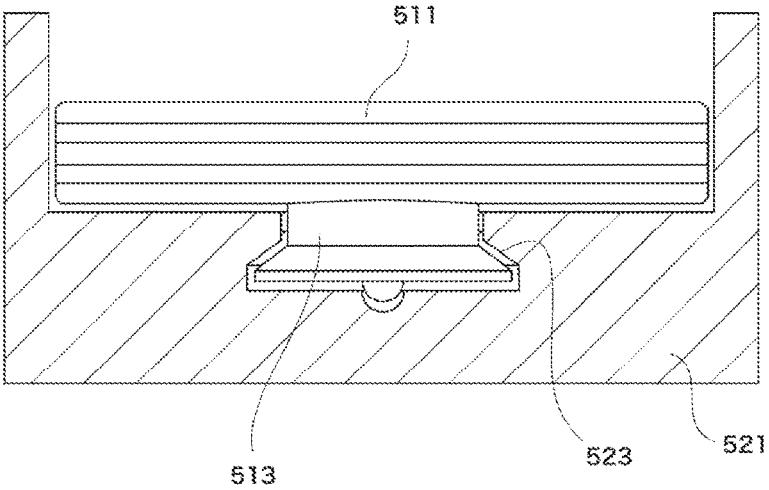
FIG. 20 is a fragmentary enlarged front sectional view of the limb and handle riser which are joined and in use in the conventional technique.
Figure 21:
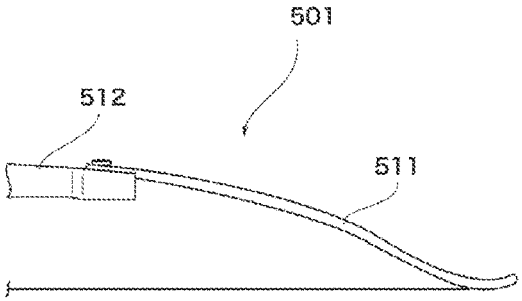
BACKGROUND ART FIG. 21
FIG. 21 is a side view of the limb and handle riser which are joined and in use in the conventional technique.
Figure 22:
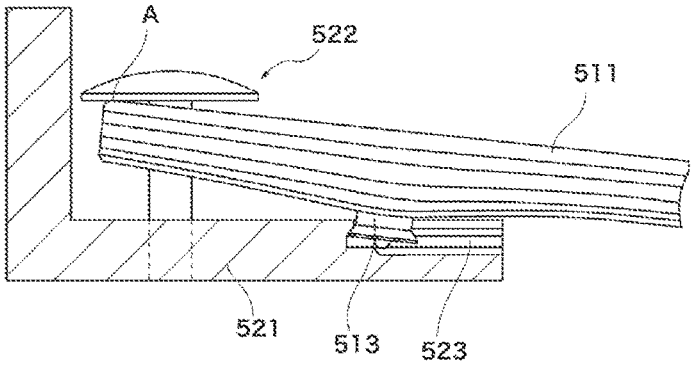
BACKGROUND ART FIG. 22
FIG. 22 is a fragmentary enlarged side sectional view of the limb and handle riser which are joined and in use in the conventional technique.

The inclined portion 232 of the housing part 231 with a concave cross section and the large-diameter portion 132 at the tip of the projection 131 contact each other and move, join each other tightly and absorb the impact while changing the contact point, centering on the lock part 133 and lock housing part 234 in the housing part 231 as shown in FIG. 12, so the limb 11 and handle riser 21 do not vibrate left and right.

In the second embodiment, in the second fitting parts, the inclination of the limb and machining errors in any maker can be easily adjusted and corrected by the eccentric locator.

REFERENCE SIGNS LIST

1 . . . archery bow
11 . . . limb
12 . . . limb-side first fitting part
13 . . . limb-side second fitting part
131 . . . projection
132 . . . large-diameter portion
133 . . . lock part
134 . . . large-diameter portion bottom
21 . . . handle riser
22 . . . handle riser-side first fitting part
221 . . . limb bolt head (handle riser-side first fitting part)
222 . . . limb bolt shaft (handle riser-side first fitting part)
223 . . . limb bolt base portion (handle riser-side first fitting part)
224 . . . limb bolt rotation axis (handle riser-side first fitting part)
225 . . . plate spring
226 . . . plate spring fixing part
23 . . . handle riser-side second fitting part
231 . . . housing part
232 . . . inclined portion
233 . . . bottom
234 . . . lock housing part
24 . . . limb bolt housing hole

The invention claimed is:

1. A limb, which is configured to be join to a handle riser including a handle riser-side second fitting part located at a tip of the handle riser and a handle riser-side first fitting part located nearer to a center of the handle riser than the handle riser-side second fitting part, comprising:

a limb-side first fitting part located at a tip of the limb; and a limb-side second fitting part located nearer to a center of the limb than the limb-side first fitting part, wherein:

either the limb-side second fitting part or the handle riser-side second fitting part is a projection, the projection is column-shaped and protrudes from a surface of either the limb or the handle riser, either the limb-side second fitting part or the handle riser-side second fitting part which has no projection is a housing part, the housing part is cylindrical and houses the projection, a side face of the housing part near a bottom of the housing part is smaller in diameter than an opening into the housing part, and the limb and the handle riser are joined by joining the limb-side first fitting part and the handle riser-side first fitting part and joining the limb-side second fitting part and the handle riser-side second fitting part.

2. The limb according to claim 1, wherein a large-diameter portion with a larger diameter than a column-shaped base portion is provided at a column-shaped tip.

3. The limb according to claim 1, wherein the housing part with a concave cross section has a diameter which decreases toward the bottom.

4. The limb according to claim 1, wherein a projection-shaped lock part is provided at a tip of the projection with a convex cross section and a lock housing part with a concave cross section to house the lock part is provided in a center of the housing part.

5. The limb according to claim 1, wherein the handle riser-side first fitting part is constantly biased toward the center of the handle riser and a head can move with a base portion as an axis.

6. A limb, which is configured to be joined to a handle riser including a handle riser-side second fitting part located at a tip of the handle riser and a handle riser-side first fitting part located nearer to a center of the handle riser than the handle riser-side second fitting part, wherein the handle riser-side second fitting part including a projection protruding from a surface of the handle riser, comprising:

a limb-side first fitting part located at a tip of the limb; and a limb-side second fitting part located nearer to a center of the limb than the limb-side first fitting part, wherein:

the limb-side second fitting part comprises a housing part that is cylindrical and configured to house the projection, a side face of the housing part near a bottom of the housing part is smaller in diameter than an opening into the housing part, and the limb is configured to be joined to the handle riser by joining the limb-side first fitting part and the handle riser-side first fitting part and joining the limb-side second fitting part and the handle riser-side second fitting part.

7. A limb, which is configured to be joined to a handle riser including a handle riser-side second fitting part located at a tip of the handle riser and a handle riser-side first fitting part located nearer to a center of the handle riser than the handle riser-side second fitting part, wherein the handle riser-side second fitting part including a housing part to house a projection, and in the housing part, a side face near a bottom being smaller in diameter than an opening, comprising:

a limb-side first fitting part located at a tip of the limb; and a limb-side second fitting part located nearer to a center of the limb than the limb-side first fitting part, wherein:

the limb-side second fitting part comprises the projection that is column-shaped and protrudes from a surface of the limb, and the limb is configured to be joined to the handle riser by joining the limb-side first fitting part and the handle riser-side first fitting part and joining the limb-side second fitting part and the handle riser-side second fitting part.

8. A handle riser, which is configured to be joined to a limb including a limb-side first fitting part located at a tip of the limb and a limb-side second fitting part located nearer to a center of the limb than the limb-side first fitting part, comprising:

a handle riser-side second fitting part located at a tip of the handle riser; and a handle riser-side first fitting part located nearer to a center of the handle riser than the handle riser-side second fitting part, wherein:

either the limb-side second fitting part or the handle riser-side second fitting part is a projection, the projection is column-shaped and protruding from a surface of either the limb or the handle riser, either the limb-side second fitting part or the handle riser-side second fitting part which has no projection is a housing part, the housing part is cylindrical and configured to house the projection, a side face of the housing part near a bottom of the housing part is smaller in diameter than an opening into the housing part, and the handle riser is joined to the limb by joining the limb-side first fitting part and the handle riser-side first fitting part and joining the limb-side second fitting part and the handle riser-side second fitting part.

9. The handle riser according to claim 8, wherein a large-diameter portion with a larger diameter than a column-shaped base portion is provided at a column-shaped tip.

10. The handle riser according to claim 8, wherein the housing part with a concave cross section has a diameter which decreases toward the bottom.

11. The handle riser according to claim 8, wherein a projection-shaped lock part is provided at a tip of the projection with a convex cross section and a lock housing part with a concave cross section to house the lock part is provided in a center of the housing part.

12. The handle riser according to claim 8, wherein the handle riser-side first fitting part is constantly biased toward the center of the handle riser and a head can move with a base portion as an axis.

13. A handle riser configured to be join to a limb including a limb-side first fitting part located at a tip of the limb and a limb-side second fitting part located nearer to a center of the limb than the limb-side first fitting part, wherein the limb-side second fitting part including a projection protruding from a surface of the limb, comprising:

a handle riser-side second fitting part located at a tip of the handle riser, the handle riser-side second fitting part comprises a housing part; and a handle riser-side first fitting part located nearer to a center of the handle riser than the handle riser-side second fitting part;

wherein:

the projection is column-shaped, the housing part is cylindrical, a side face of the housing part near a bottom of the housing part is smaller in diameter than an opening into the housing part, and the handle riser is configured to be joined to the limb by joining the limb-side first fitting part and the handle riser-side first fitting part and joining the limb-side second fitting part and the handle riser-side second fitting part.

14. A handle riser, which is configured to be joined to a limb including a limb-side first fitting part located at a tip of the limb and a limb-side second fitting part located nearer to a center of the limb than the limb-side first fitting part, wherein the limb-side second fitting part including a housing part configured to house a projection of the limb, wherein a side face of the housing part near a bottom being smaller in diameter than an opening of the housing part, comprising:

a handle riser-side second fitting part located at a tip of the handle riser; and a handle riser-side first fitting part located nearer to a center of the handle riser than the handle riser-side second fitting part, wherein:

the handle riser-side second fitting part includes the projection that is column-shaped and protrudes from a surface of the handle riser, the housing part which is cylindrical is configured to house the projection; and the handle riser is configured to be joined to the limb by joining the limb-side first fitting part and the handle riser-side first fitting part and joining the limb-side second fitting part and the handle riser-side second fitting part.

* * * * *